US006129064A

United States Patent [19]

Berner et al.

[11] Patent Number: 6,129,064

[45] Date of Patent: Oct. 10, 2000

[54] LIQUID-COOLED CYLINDER HEAD FOR A MULTICYLINDER INTERNAL COMBUSTION ENGINE

[75] Inventors: Klaus Berner, Untergruppenbach; Wolfgang Kizler, Fellbach; Roland Meyer, Stuttgart; Bernard Vethacke, Wendlingen, all of Germany

[73] Assignee: Daimler-Benz Aktiengesellschaft, Stuttgart, Germany

[21] Appl. No.: 09/143,626

[22] Filed: Aug. 28, 1998

[30] Foreign Application Priority Data

Aug. 28, 1997 [DE] Germany ..... 19737492

[51] Int. Cl.[7] ..... F02F 1/36

[52] U.S. Cl. ..... 123/193.3; 123/41.82 R

[58] Field of Search ..... 123/41.82 R, 193.3, 123/193.5

[56] References Cited

U.S. PATENT DOCUMENTS

| | | | |
|---|---|---|---|
| 3,363,608 | 1/1968 | Scherenberg et al. | 123/193.3 |
| 3,410,256 | 11/1968 | Herschmann | 123/193.3 |
| 3,765,385 | 10/1973 | Conrad | 123/41.84 |
| 4,781,158 | 11/1988 | Bauer et al. | 123/193.3 |
| 4,892,069 | 1/1990 | Rosch et al. | 123/193.3 |
| 5,010,853 | 4/1991 | Kubis et al. | 123/41.84 |
| 5,463,991 | 11/1995 | Krotky et al. | 123/195 R |
| 5,630,389 | 5/1997 | Self | 123/193.3 |
| 5,752,480 | 5/1998 | Berggren et al. | 123/193.3 |

*Primary Examiner*—Marguerite McMahon
*Assistant Examiner*—Jason Benton
*Attorney, Agent, or Firm*—Kenyon & Kenyon

[57] ABSTRACT

A liquid-cooled cylinder head for a multicylinder internal combustion engine. The cylinder head has a coolant chamber in which gas exchange passages running in the direction of a transverse engine axis and at least one chamber for a spark plug and/or an injection nozzle are arranged. Also, bolt pipes for distributing the bolt tension forces of the cylinder head bolts are provided, the cylinder head being joinable to a crankcase of the internal combustion engine with interposition of a cylinder head seal. The bolt pipes have ribs formed by thickened configurations of adjacent wall sections of the gas exchange passages in the region of the cylinder head bolt. A high, uniform surface pressure on the cylinder head seal is thereby enabled, even in the regions between the cylinder head bolts, and even when space is restricted.

3 Claims, 2 Drawing Sheets

LIQUID-COOLED CYLINDER HEAD FOR A MULTICYLINDER INTERNAL COMBUSTION ENGINE

FIELD OF THE INVENTION

The present invention relates to a liquid-cooled cylinder head for a multicylinder internal combustion engine, and in particular, to a liquid-cooled cylinder head having bolt pipes for distributing bolt tension forces of cylinder head bolts.

RELATED TECHNOLOGY

Japanese Patent Document No. 59 96 341 discloses a liquid-cooled cylinder head for a multicylinder internal combustion engine. The cylinder head has conventional bolt pipes for the cylinder head bolts which convey the tension forces of the cylinder head bolts on the small cross section of the pipes from the cover to the base plate of the cylinder head. In order also to distribute the bolt tensile forces into the base regions between the bolt pipes, a T-shaped flexural beam, which is joined via a rib to the gas exchange passages and is intended also to convey the bolt tension forces into the interstitial regions, is arranged between the bolt pipes.

With such a design for distributing the bolt tension forces, however, the manner in which forces are introduced via the flexural member is too nonuniform to achieve an optimal uniform force distribution in the region between the bolt pipes. The rigidity of the continuous bolt pipes over their length allows only a small degree of force transfer into the flexural member. The preload introduced via the flexural member into the combustion chamber boundary of the cylinder head base is therefore small, and does not withstand an elevated gas pressure in the internal combustion engine. Uniform surface pressure on the cylinder head seal arranged between the cylinder head and crankcase, in order to ensure optimum scaling, therefore cannot be achieved. A further disadvantage of the embodiment is represented by the enormous space requirement of the flexural beam. So this design cannot be used when space in the cylinder head is very restricted, in particular if the flexural beam is to be made stronger in order to achieve better force distribution.

German Patent No. 38 36 117 C1 shows a cylinder head, and is cited here for general technical background.

SUMMARY OF THE INVENTION

It is an object of the present invention to provide a liquid-cooled cylinder head for a multicylinder internal combustion engine with which, even when space is restricted, strong and highly uniform surface pressure on the cylinder head seal may be achieved even in the regions between the cylinder head bolts.

The present invention provides a liquid-cooled cylinder head for a multicylinder internal combustion engine, having a coolant chamber in which gas exchange passages running in the direction of a transverse engine axis and at least one chamber for a spark plug and/or an injection nozzle are arranged, and having bolt pipes for distributing the bolt tension forces of the cylinder head bolts, the cylinder head being joinable to a crankcase of the internal combustion engine with interposition of a cylinder head seal. Adjacent wall sections (12) of the gas exchange passages (5) are of thickened configuration in the region of the cylinder head bolts (8) to form ribs (13) which are part of the bolt pipes (11).

An advantage of the present invention is the simplification of the bolt pipes. Adjacent wall sections of the gas exchange passages are of thickened configuration in the region of the cylinder head bolts and thereby constitute ribs which are part of the bolt pipes. The bolt pipes are thus not configured as continuous columns. The simplification of the bolt pipes results in lower weight for the cylinder head.

A further advantage lies in the distribution of the bolt tension force over the bolt pipes in the cylinder head. The bolt pipes are not configured as "conventional columns" which convey the bolt force only over the small column cross section from the cover to the base of the cylinder head, but rather comprise ribs adjacent to a column-like section which allow a directed force distribution into the regions between the cylinder head bolts. The bolt tension force of the cylinder head bolts can be distributed, shortly beyond their entrance into the conventional column-like section of the bolt pipe and via the ribs adjacent thereto, into the cylinder head. The surface pressure on the cylinder head seal is thus equalized, with particular advantage for the regions in the center beneath the gas exchange passages. The uniform distribution of the bolt tension forces enable the surface pressure acting on the cylinder head seal to better withstand the significant gas forces present during operation of the internal combustion engine.

After the internal combustion engine is started, the cylinder head and the crankcase of the internal combustion engine heat up. As a result, the coolant also heats up very quickly. Advantageously, the cylinder head bolts are therefore surrounded over a portion of their length by a section of the coolant chamber, so that they are also brought very quickly, by the coolant, to the temperature of the surrounding components. Since the cylinder head bolts heat up concurrently with the cylinder head and the crankcase, and thereby also expand, excessive stress on the cylinder head material is prevented, thus making it possible to dispense with conventional bolt pipes, or columns.

BRIEF DESCRIPTION OF THE DRAWINGS

Exemplary embodiments of the present invention are explained in further detail below with reference to the drawings, in which.

DETAILED DESCRIPTION

Figure 1:
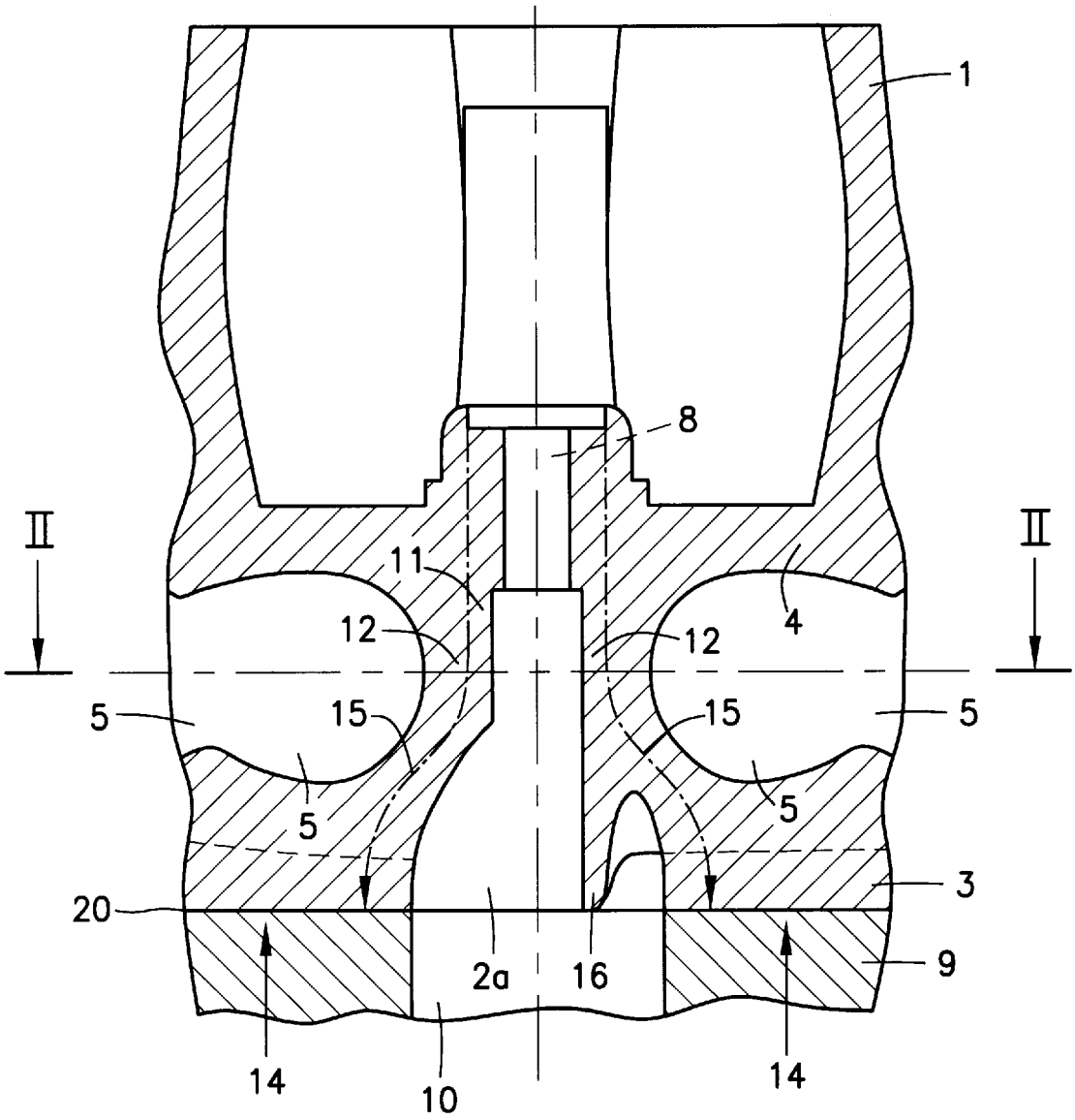
FIG. 1 shows a portion of a longitudinal section through a liquid-cooled cylinder head of an internal combustion engine according to the present invention that is joined to a crankcase of the internal combustion engine.

FIG. 1 depicts a liquid-cooled cylinder head I for a multicylinder internal combustion engine (not depicted in further detail), the left half depicting a first exemplary embodiment and the right half a second exemplary embodiment of the invention.

Figure 2:
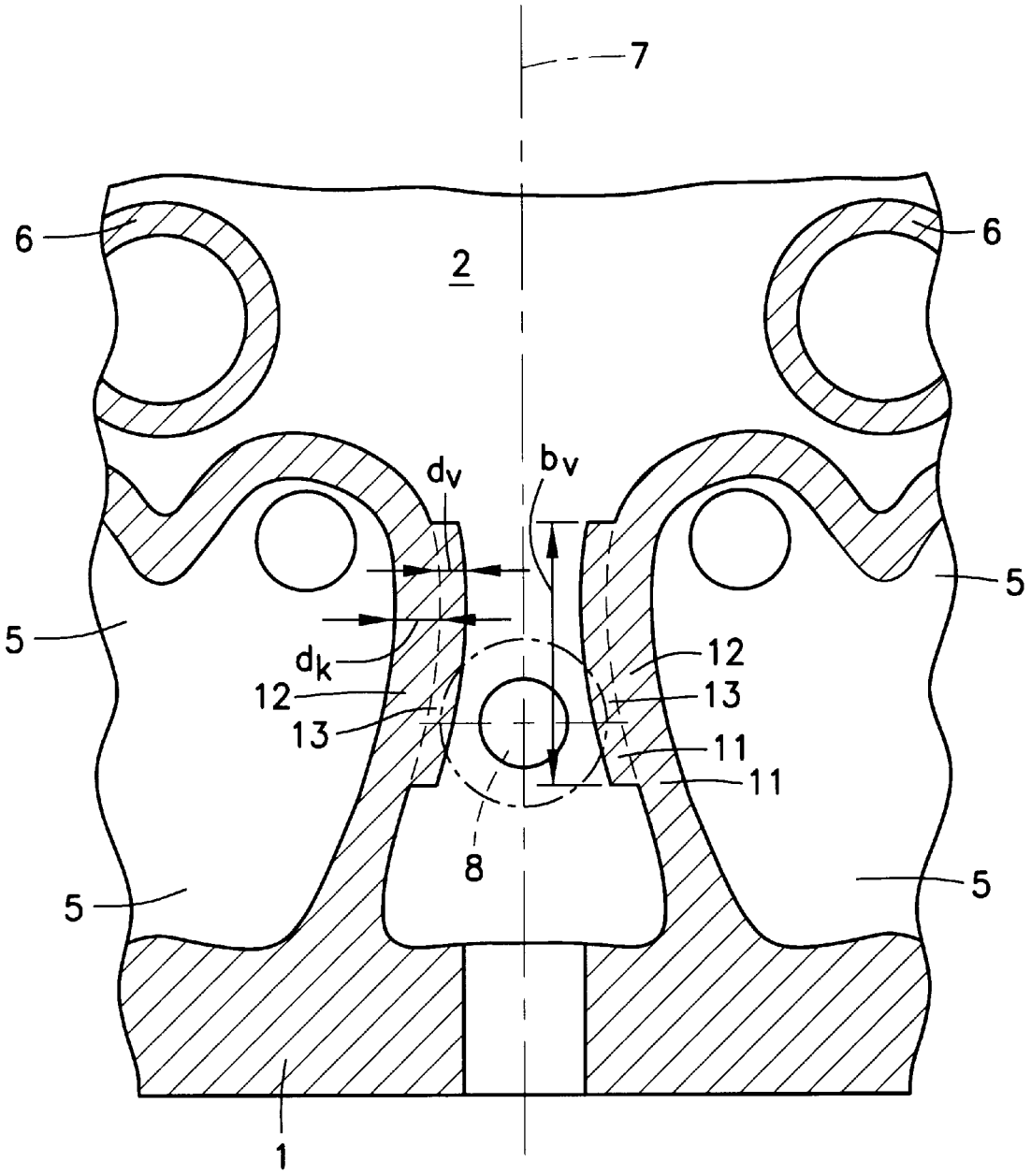
FIG. 2 shows a portion of a section through the cylinder head of the internal combustion engine along line II—II of FIG. 1.

Cylinder head 1 has a coolant chamber 2, as shown in FIG. 2, of which only inlet 2*a* is depicted in FIG. 1. Coolant chamber 2 is delimited at the bottom by a cylinder head base 3 and at the top by cylinder head cover 4 which is arranged at a distance above cylinder head base 3. In the second exemplary embodiment, cylinder head 1 additionally has a projection 16 arranged in inlet 2*a* and projecting freely downward. Arranged in coolant chamber 2 are gas exchange passages 5 and, as shown in FIG. 2, chambers 6 for spark plugs and/or injection nozzles. As shown in FIG. 2, gas exchange passages 5 extend in the direction of a transverse engine axis. Through cylinder head bolts 8 outlined in FIGS. 1 and 2, cylinder head 1 is detachably joined, with interposition of a cylinder head seal 20, to a crankcase 9 of the internal combustion engine. Pressing of cylinder head 1 onto crankcase 9, and thus clamping of the cylinder head seal between cylinder head 1 and crankcase 9, is accomplished when cylinder head bolts 8 are tightened with the requisite bolt preload. Over at least a portion of their length, cylinder head bolts 8 extend unconstrainedly through a section, in this case inlet 2*a*, of coolant chamber 2 in cylinder head 1, and through a coolant chamber section 10 in crankcase 9. Coolant thus flows around cylinder head bolts 8, which are rapidly brought to the temperature of the surrounding cylinder head 1 and crankcase 9. Cylinder head bolts 8 are passed through bolt pipes 11, described below in more detail, of cylinder head 1, which serve to distribute the bolt tension forces of cylinder head bolts 8 from cylinder head cover 4 to cylinder head base 3.

As shown in FIG. 2, in both exemplary embodiments of the invention, bolt pipes 11 for receiving cylinder head bolts 8 are partially formed by adjacent wall sections 12 of gas exchange passages 5, which are, for example, intake passages. Wall sections 12 have a thickened configuration in the region of cylinder head bolts 8 in order to form ribs 13. The configuration of bolt pipes 11 in this embodiment of the present invention results in a distribution of the bolt tension forces into regions 14 beneath gas exchange passages 5, as shown in FIG. 1.

Referring again to FIG. 1, dot-dash arrows 15 represent the introduction of force by cylinder head bolts 8 into cylinder head 1, and the subsequent force distribution by ribs 13 into regions 14 beneath gas exchange passages 5. Projection 16 of the second exemplary embodiment of the present invention has no influence on this force distribution since projection 16 is not supported from below, but rather projects unconstrainedly into inlet 2*a* or coolant chamber section 10. Because of the way in which the shape of rib 13 is adapted to wall sections 12 of gas exchange passages 5, the preload force from rib 13 is oriented in the direction of arrow 15 toward the cylinder head seal. In this way sufficient surface pressure on the seal is also achieved in regions 14 adjacent to cylinder head bolts 8 between gas exchange passages 5.

Minimum cross section $A_{Rmin}$ of rib 13 which partially constitutes bolt pipe 11 may be described approximately by the following formula:

$$A_{Rmin} \approx (d_K + d_V) \times b_V = 0.5 F_S / 0.8 \sigma_{yield} \text{ (in mm}^2\text{)}$$

where $A_{Rmin}$=Required minimum cross section of the rib;

$d_K$=Thickness of the gas exchange passage;

$d_V$=Thickness of the thickening forming one part of the rib;

$b_V$=Width of the thickening;

$F_S$=Bolt force of the cylinder head bolt; and $\sigma_{yield}$=Yield point of the cylinder head bolt.

What is claimed is:

1. A liquid-cooled cylinder head for a multicylinder internal combustion engine, the cylinder head comprising:

a coolant chamber having gas exchange passages in a direction of a transverse axis of the internal combustion engine and having at least one chamber for a spark plug and/or an injection nozzle, the gas exchange passages having respective wall sections; and at least one bolt pipe for receiving a respective cylinder head bolt, the at least one bolt pipe including ribs for distributing a bolt tension force of the respective cylinder head bolt, the ribs formed by thickened configurations of the wall sections in a region of the respective cylinder head bolt;

the cylinder head being joinable to a crankcase of the internal combustion engine with interposition of a cylinder head seal.

2. The liquid-cooled cylinder head as recited in claim 1 wherein the respective cylinder head bolt is completely surrounded by engine coolant over at least a portion of its length.

3. The liquid-cooled cylinder head as recited in claim 1 wherein the at least one bolt pipe includes a plurality of bolt pipes.

* * * * *

UNITED STATES PATENT AND TRADEMARK OFFICE

CERTIFICATE OF CORRECTION

PATENT NO. : 6,129,064
DATED : October 10, 2000
INVENTOR(S) : Berner et al.

It is certified that error appears in the above-identified patent and that said Letters Patent is hereby corrected as shown below:

Column 1,
Line 36, change "... scaling ..." to -- sealing --.

Column 2,
Line 52, change "... I ..." to -- 1 --.

Column 3,
Line 1, "... axis." insert new paragraph beginning with "Through ...".

Signed and Sealed this

Twenty-third Day of October, 2001

*Attest:*

Nicholas P. Godici

NICHOLAS P. GODICI
*Acting Director of the United States Patent and Trademark Office*

*Attesting Officer*